United States Patent [19]

Pettitt

[11] Patent Number: 5,044,892

[45] Date of Patent: Sep. 3, 1991

[54] SWASH PLATE COMPRESSOR LUBRICATION SYSTEM

[75] Inventor: Edward D. Pettitt, Burt, N.Y.

[73] Assignee: General Motors Corporation, Detroit, Mich.

[21] Appl. No.: 488,195

[22] Filed: Mar. 5, 1990

[51] Int. Cl.[5] ..... F04B 1/14

[52] U.S. Cl. ..... 417/269; 184/6.17

[58] Field of Search ..... 184/6.17; 417/269, 271

[56] References Cited

U.S. PATENT DOCUMENTS 4,260,337 4/1981 Nomura ..... 417/269

4,347,046 8/1982 Brucken et al. ..... 417/269

4,413,954 11/1983 Okazaki ..... 417/269

*Primary Examiner*—Gerald A. Michalsky

*Attorney, Agent, or Firm*—R. L. Phillips

[57] ABSTRACT

A swash plate compressor for a motor vehicle air conditioning system has a lubrication channel in each of its valve plate faces which is open partially along its length by one of the suction reed valves to connect the compressor's crankcase directly with one of the pumping chambers in parallel with this valve's suction port during the intake stroke and is then closed by this suction valve along with the suction port during the discharge stroke.

3 Claims, 2 Drawing Sheets

SWASH PLATE COMPRESSOR LUBRICATION SYSTEM

TECHNICAL FIELD

This invention relates to the lubrication of a swash plate compressor and more particularly to a lubrication system therefor wherein gaseous refrigerant with entrained lubricant is circulated across the critical bearing surfaces between the crankcase and a certain pumping chamber.

BACKGROUND OF THE INVENTION

In swash plate compressors such as those used in motor vehicle air conditioning systems, it is common practice to employ a passive or pumpless lubrication system wherein gaseous refrigerant with entrained lubricant is circulated through the crankcase to lubricate the critical bearing surfaces of the machine. One way of assuring lubrication of the critical bearing surfaces is to communicate the crankcase with the pumping chambers via a passageway(s) across the bearing surfaces. Examples of such attempts are disclosed in U.S. Pat. Nos. 4,260,337 and 4,413,954. In the former patent, a passageway is provided on each side of the swash plate that extends from the crankcase across the respective bearing surfaces and directly connects with a selected pumping chamber on the respective swash plate side. In the latter patent, the lubrication passageway back to the crankcase is through the inlet port to the selected chamber with the opening for lubrication occurring during the respective suction stroke. In both these designs there is either a long enclosed channel or hole which has a tendency to become obstructed or blocked due to debris or particles generated during machining and/or operation of the compressor. This is because such designs need to have their channel enclosed the entire distance from the outside diameter of the drive shaft bore to the diameter of the suction port or cylinder wall, respectively. In the case of the inlet port connection, the channel is longer and thus relatively more susceptible to clogging by an accumulation of particles. Moreover, it has been found that where communication is via the suction port in an attempt to take advantage of a venturi effect, the suction gas passing through this suction port has in actuality a relatively low velocity so that the venturi effect is negligible. Furthermore, such designs that utilize the inlet port require that the valve plate be exposed to suction pressure opposite the shaft. However, many currently manufactured compressors have discharge gas pressure in the center of the cylinder head and the proposed designs, therefore, are not compatible therewith.

SUMMARY OF THE INVENTION

According to the present invention, a lubricant channel or groove is formed in each valve plate behind one of the suction reed valves and extends from the drive shaft bore to a point intermediate the length of this valve where it dead ends so that only during each suction stroke of the respective piston does this valve then open the lubricant channel, thereby drawing refrigerant with entrained lubricant from the crankcase across the critical bearing surfaces. By placing the lubricant channel under the suction valve reed, discharge gas is effectively prevented from blowing back into the crankcase when the piston is on its compressor stroke. Moreover, the lubrication groove of the present invention has a limited length of continuously enclosed cross section by operation of the suction reed valve. The length of this continuously enclosed portion of the channel is determined only by the distance between the outside diameter of the shaft bearing bore and the cylinder bore. The rest of the lubrication channel is opened during each suction stroke allowing the lubrication channel to be cleansed of any debris. Furthermore, the lubrication system is relatively simpler and less costly than previous designs to manufacture since it is accomplished in both front and rear valve plates by simple machining and requires no additional parts. In addition, the present design readily lends itself to where the discharge gas pressure is in the center of the cylinder head.

It is therefore an object of the present invention to provide a new and improved passive lubrication system for a swash plate compressor.

Another object is to provide a new and improved passive lubrication system wherein refrigerant with entrained lubricant is circulated past critical bearing surfaces of the compressor between the compressor's crankcase and one of the pumping chambers by a channel whose enclosed length is only limited by the distance between the drive shaft bearing bore and the pumping chamber bore.

Another object is to provide in a swash plate compressor a lubrication passage that communicates the crankcase through the drive shaft bore with a pumping chamber via a dead ended groove in the valve plate behind a suction reed valve.

Another object is to provide a simpler, less costly passive lubrication system for a swash plate compressor that utilizes one of the suction reed valves to close and open a dead ended lubricant channel in the piston side of the valve plate to communicate the crankcase with one of the pumping chambers via critical bearing surfaces in the compressor.

These and other objects, advantages and features of the present invention will become more apparent from the following description and drawing in which:

DETAILED DESCRIPTION OF THE DRAWINGS

Figure 1:
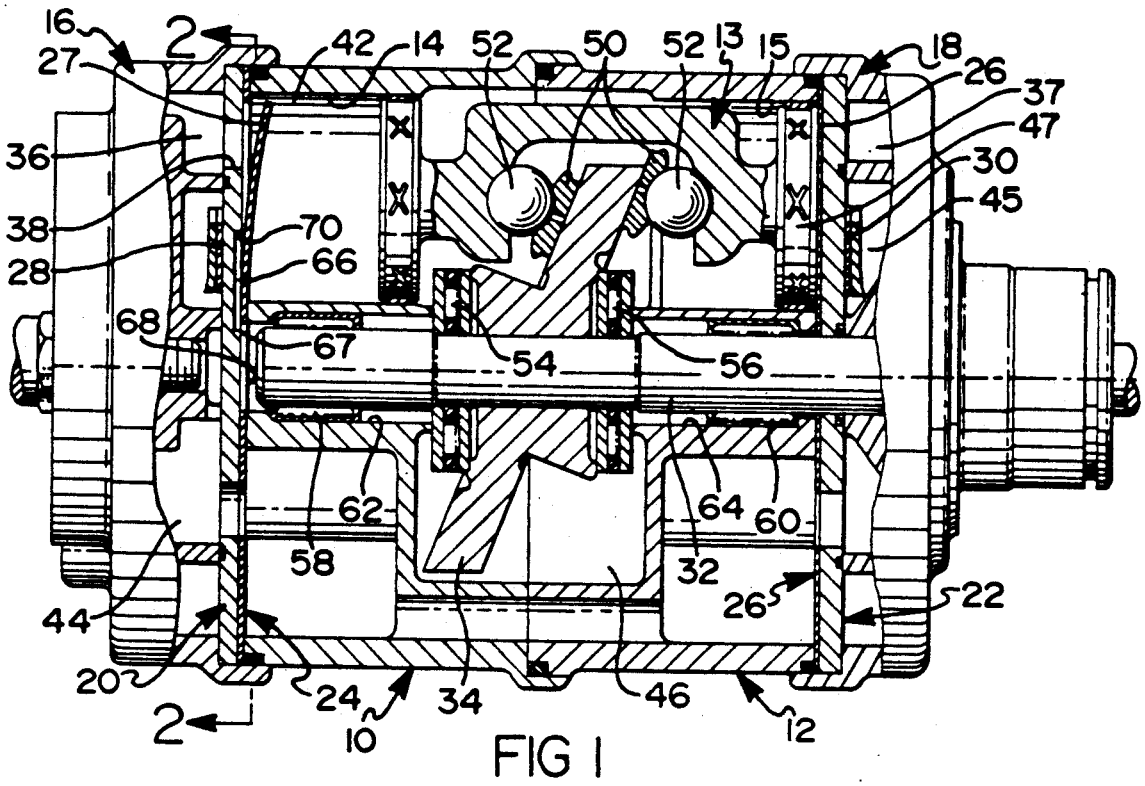
FIG. 1 is a side view with parts broken away of a swash plate compressor having the passive lubrication system of the present invention.

Referring to the drawings, there is shown a swash plate compressor for use in a motor vehicle air conditioning system. The compressor, apart from the addition of the present invention, is like that disclosed in U.S. Pat. No. 4,347,046 which is hereby incorporated by reference. The compressor basically comprises a pair of mating cylinder blocks 10, 12, three (3) double-ended pistons 13 mounted in radially and angularly located and aligned piston bores or cylinders 14 and 15 in the cylinder blocks (only one such arrangement being shown), a pair of heads 16, 18, valve plates 20, 22 mounted between the respective heads and blocks, suction valve discs 24, 26 with integrally formed reed valves 27 mounted against the piston side of the respective valve plates, discharge valves 28, 30 for the respective axially oppositely disposed pumping chambers mounted on the head side of the respective valve plates, and a drive shaft 32 that is supported in the cylinder blocks and has a swash plate 34 that drives the pistons in conventional manner. The heads 16, 18 have radially outwardly located suction cavities 36, 37, respectively, which receive low pressure gaseous refrigerant from an evaporator (not shown) and from which the gaseous refrigerant is drawn through suction ports 38 in the respective valve plates into the associated pumping chambers 42 on opening of the respective reed valves 27 on the intake stroke (only the left hand suction port and valve arrangement being shown). Then on the discharge stroke, gaseous refrigerant is compressed and discharged via the respective exhaust valves 28 and 30 into centrally located discharge cavities 44 and 45 in the respective heads from which the high pressure gaseous refrigerant is delivered to a condenser (not shown).

Lubricant such as a low viscosity mineral oil is entrained with the gaseous refrigerant and is circulated within the enclosed crankcase 46 defined by the cylinder blocks to lubricate the critical bearing surfaces; namely, the swash plate, and its drive to the pistons via slippers 50 and balls 52, a pair of thrust bearings 54 and 56 on opposite sides of the swash plate hub and a pair of needle bearings 58 and 60 which radially support the drive shaft in centrally located and axially aligned shaft bearing bores 62 and 64 in the cylinder blocks. In the compressor shown, the gaseous refrigerant enters the compressor at the left hand head 16 where it passes directly to the suction cavity 36 and via a port 65 in the left hand valve plate 20 and valve disc 24 and thence the crankcase 46 and through the other valve disc 26 and valve plate 22 to the other suction cavity 37. The entrained oil is thus circulated within the crankcase prior to being delivered to the right hand cylinder head and this is the way in which lubrication of the bearing surfaces has previously been effected. However, it will also be understood that all the incoming gaseous refrigerant with entrained oil could be circulated first to the crankcase and thence equally to both the front and rear suction cavities. For a more detailed understanding of the compressor and previous method of lubrication, reference may be made to the aforementioned U.S. Pat. No. 4,347,046.

Figure 2:
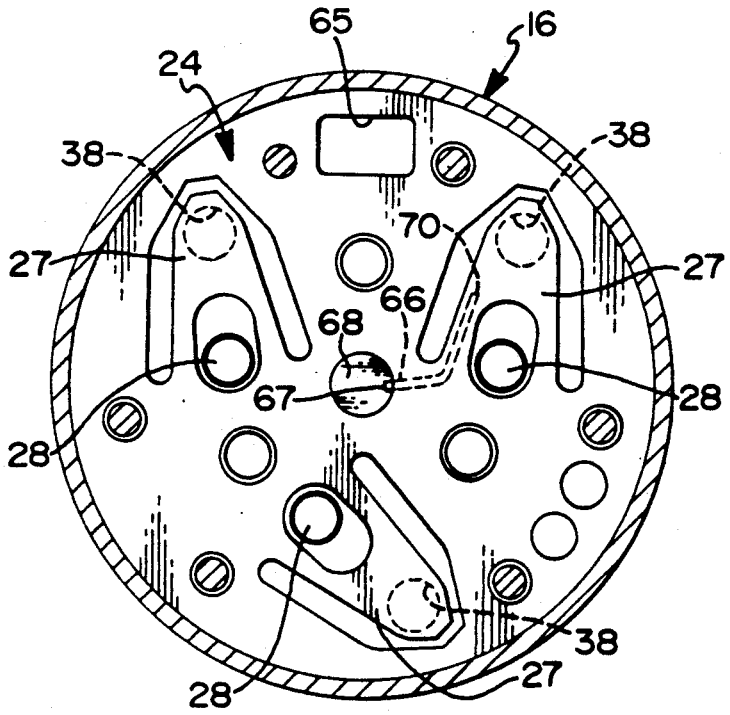
FIG. 2 is a view taken along the line 2—2 in FIG. 1.
Figure 3:
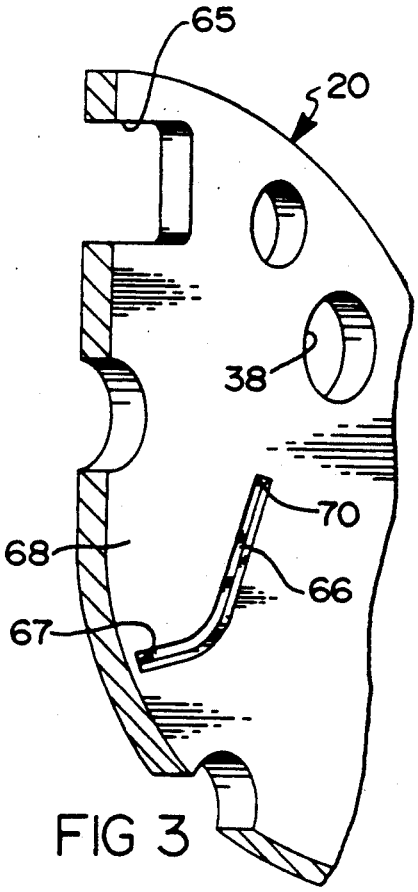
FIG. 3 is a partial view of the left hand valve plate in the previous figures.
Figure 4:
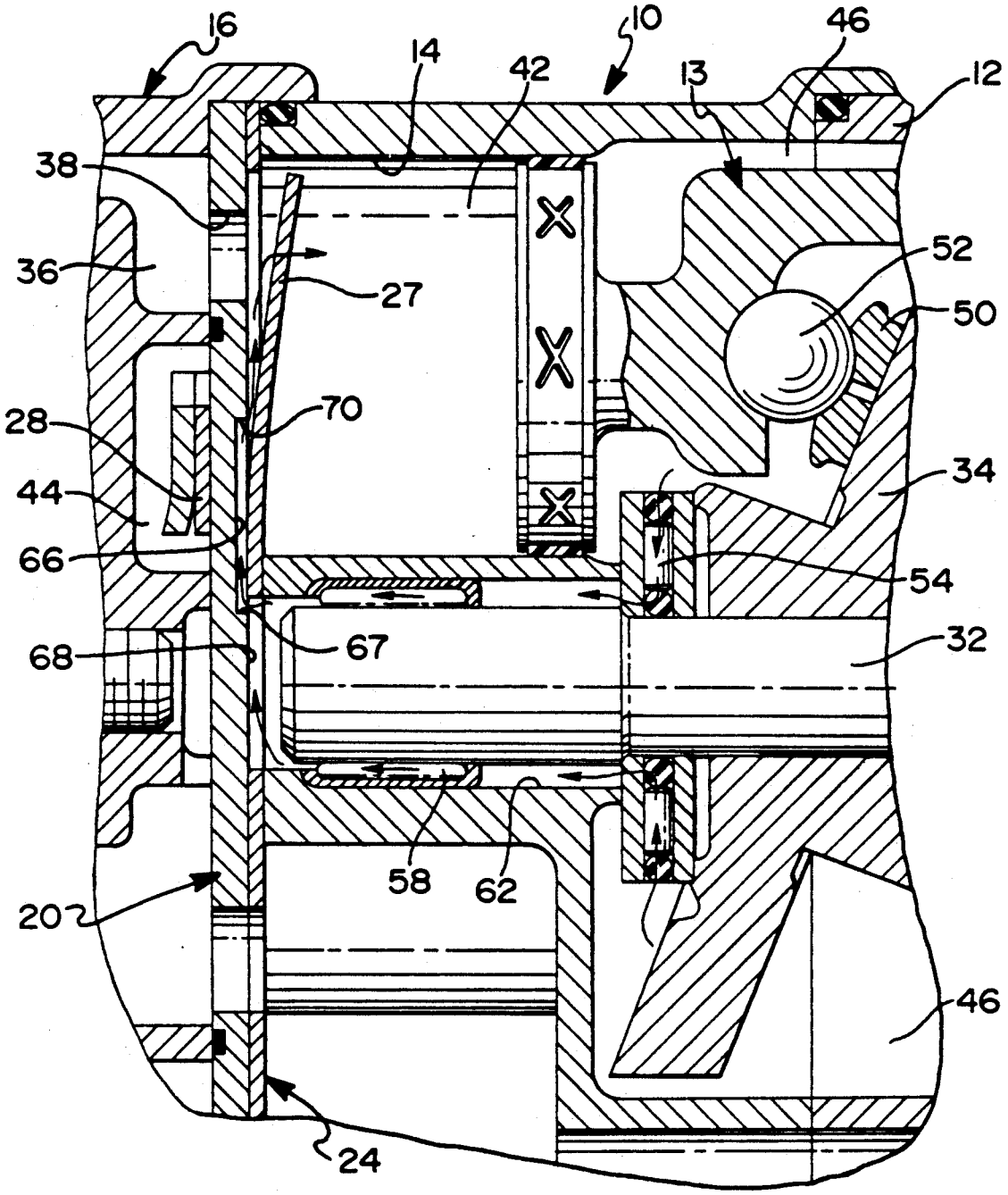
FIG. 4 is an enlarged view of the lubrication system at the left end of the compressor in FIG. 1.

According to the present invention, a groove or channel 66 is machined in the piston side 68 of each valve plate (only that in the left hand valve plate 20 being shown) and extends from a point 67 slightly inward of the outer diameter of the shaft bore 62 upward and outward toward one of the suction ports 38 that is elevated relative to the shaft bore. As best seen in FIGS. 2 and 4, the lubrication channel 66 extends behind the respective suction reed valve 27 about half way along the length thereof where it dead ends at 70 short of reaching the respective suction port 38. Thus when the suction reed valve is normally closed, which is during the discharge stoke, it closes the lubrication channel 66 to the respective pumping chamber 42 along with closure of the respective intake port 38. But then when this suction reed valve opens during the suction stroke to open the intake port, it simultaneously opens that radially outward end portion of the lubricant channel past the piston cylinder bore diameter to the pumping chamber as best seen in FIG. 4 with the result that the gaseous refrigerant with entrained oil is drawn through the respective thrust bearing 54 and needle bearing 58 and thence via the lubricant channel into the pumping chamber by virtue of this pumping chamber's suction on this channel. Because this pumping chamber is directly communicated with the crankcase by the opening of the lubricant channel, the pressure at the bearings 54 and 58 is instantaneously reduced to a lower degree than where the communication would be via the suction port itself recognizing that there is relatively low velocity in the suction gas passing through same. And it will be appreciated that a similar lubrication channel is provided at the opposite end of the compressor so that such lubrication occurs with the bearings 56 and 60 as well as 54 and 58. However, it will also be appreciated that the lubricant circuits may only include the radial bearings where they are not serially connected as shown.

Because the lubrication channel is initially formed as an open channel in the valve plate, it is less likely to become blocked or plugged due to debris or particles generated during machining and also during operation of the compressor. Moreover, it will be appreciated that when the valve plate is assembled in the compressor, the open channel maintains a limited length of enclosure. That is, the length of continuously enclosed channel is determined only by the distance between the outer diameter of the shaft bearing bore 64 and the cylinder or piston bore 14. The rest of the channel is open during the suction stroke allowing the lubrication channel to be cleansed of any debris. Moreover, because the channel is periodically effectively shortened in length in terms of enclosure, it is far less susceptible to clogging by an accumulation of foreign particles that enter into the refrigeration system. Furthermore, it will be appreciated that the lubrication channel is formed in the existing valve plate rather than requiring the addition of any new parts and such lubrication channel can be simply formed such as by a milling operation. Moreover, since the lubrication channel directly communicates the drive shaft bearing bore with the cylinder, it readily lends itself to where the discharge gas pressure is contained centrally of the respective head rather than radially outward.

The foregoing description of the presently preferred embodiment of the invention has been presented for purposes of illustration and description. It is not intended to be exhaustive or limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments or modifications as is suited to the particular use contemplated. All such modifications and variations are within the scope of the invention as determined by the appended claims when interpreted in accordance with the breadth to which they are fairly, legally and equitably entitled.

The embodiments of the invention in which an exclusive property or privilege is claimed are defined as follows:

1. A swash plate compressor that circulates refrigerant with entrained lubricant for compressor lubrication, said compressor comprising a pair of combined cylinder blocks having centrally located axially aligned shaft bores and radially and angularly located piston bores, said cylinder blocks defining a crankcase chamber therebetween, double-ended pistons mounted in the respective piston bores, a drive shaft, radial bearings mounting said drive shaft in the respective shaft bores, a swash plate fixed to said drive shaft and located in said chamber and operatively drivingly connected to said pistons, a pair of thrust bearings axially supporting said swash plate between said cylinder blocks, a pair of valve plates arranged on opposite ends of said combined cylinder blocks to close said cylinder bores and cooperate with the respective pistons to define pumping chambers, cylinder heads arranged with the respective valve plates to define suction cavities and discharge cavities at opposite ends of the combined cylinder blocks, each of said valve plates having a suction port and a discharge port for connecting each associated pumping chamber with the associated suction and discharge cavities, suction reed valves for opening the respective suction ports in response to differential pressure effected thereon by piston movement, discharge valves for opening the respective discharge ports in response to pressure rise in the associated pumping chamber, the improvement comprising:

a lubrication channel in the piston side of each of the valve plates extending from the shaft bearing bore in the associated cylinder block behind one of the associated suction reed valves to an intermediate point between said shaft bearing bore and said one suction reed valve, said lubrication channel being sized and arranged so as to be closed along its length by said one suction reed valve when said one suction reed valve closes the associated suction port but then be opened by said one suction reed valve to the associated pumping chamber in parallel relationship with the associated suction port when said one suction reed valve opens whereby refrigerant with entrained lubricant is forced to flow from the crankcase chamber through at least the associated radial bearing and thence via the lubrication channel to the associated pumping chamber.

2. A swash plate compressor that circulates refrigerant with entrained lubricant for compressor lubrication, said compressor comprising a pair of combined cylinder blocks having centrally located axially aligned shaft bores and radially and angularly located piston bores, said cylinder blocks defining a crankcase chamber therebetween, double-ended pistons mounted in the respective piston bores, a drive shaft, radial bearings mounting said drive shaft in the respective shaft bores, a swash plate fixed to said drive shaft and located in said chamber and operatively drivingly connected to said pistons, a pair of thrust bearings axially supporting said swash plate between said cylinder blocks, a pair of valve plates arranged on opposite ends of said combined cylinder blocks to close said cylinder bores and cooperate with the respective pistons to define pumping chambers, cylinder heads arranged with the respective valve plates to define suction cavities and discharge cavities at opposite ends of the combined cylinder blocks, each of said valve plates having a suction port and a discharge port for connecting each associated pumping chamber with the associated suction and discharge cavities, suction reed valves for opening the respective suction ports in response to differential pressure effected thereon by piston movement, discharge valves for opening the respective discharge ports in response to pressure rise in the associated pumping chamber, the improvement comprising:

a lubrication channel in the piston side of each of the valve plates extending from the shaft bearing bore in the associated cylinder block to an intermediate point between said shaft bearing bore and one of said suction ports in the respective valve plate, said lubrication channel being sized and arranged so as to be closed along its length by the suction reed valve associated with said one suction port when said one suction reed valve is closed but then be opened by said one suction reed valve to the associated pumping chamber in parallel relationship with said one suction port when said one suction reed valve opens said one suction port whereby refrigerant with entrained lubricant is forced to flow from the crankcase chamber through at least the associated radial bearing and thence via the lubrication channel to the associated pumping chamber.

3. A swash plate compressor that circulates refrigerant with entrained lubricant for compressor lubrication, said compressor comprising a pair of combined cylinder blocks having centrally located axially aligned shaft bores and radially and angularly located piston bores, said cylinder blocks defining a crankcase chamber therebetween, double-ended pistons mounted in the respective piston bores, a drive shaft, radial bearings mounting said drive shaft in the respective shaft bores, a swash plate fixed to said drive shaft and located in said chamber and operatively drivingly connected to said pistons, a pair of thrust bearings axially supporting said swash plate between said cylinder blocks, a pair of valve plates arranged on opposite ends of said combined cylinder blocks to close said cylinder bores and cooperate with the respective pistons to define pumping chambers, cylinder heads arranged with the respective valve plates to define suction cavities and discharge cavities at opposite ends of the combined cylinder blocks, each of said valve plates having a suction port and a discharge port for connecting each associated pumping chamber with the associated suction and discharge cavities, suction reed valves for opening the respective suction ports in response to differential pressure effected thereon by piston movement, discharge valves for opening the respective discharge ports in response to pressure rise in the associated pumping chamber, the improvement comprising:

a lubrication channel in the piston side of each of the valve plates extending from the shaft bearing bore in the associated cylinder block to an intermediate point between said shaft bearing bore and one of said suction ports in the respective valve plate, said lubrication channel being sized and arranged so as to be closed along its length by the suction reed valve associated with said one suction port when said one suction reed valve is closed but then be opened by said one suction reed valve to the associated pumping chamber in parallel relationship with said one suction port when said one suction reed valve opens said one suction port whereby refrigerant with entrained lubricant is forced to flow from the crankcase chamber through at least the associated radial and thrust bearings and thence via the lubrication channel to the associated pumping chamber.

* * * * *